US005511768A

United States Patent [19]

Kremer et al.

[11] Patent Number: 5,511,768

[45] Date of Patent: Apr. 30, 1996

[54] TAP HOLE PLUGGING DEVICE

[75] Inventors: Victor Kremer; Emile Lonardi, both of Grand Duchy, Luxembourg; Philippe Malivoir, Thionville, France

[73] Assignee: Paul Wurth S.A., Luxembourg

[21] Appl. No.: 372,462

[22] Filed: Jan. 13, 1995

[30] Foreign Application Priority Data

Jan. 17, 1994 [LU] Luxembourg ..... LU 88 453

[51] Int. Cl.[6] ..... C21C 5/48

[52] U.S. Cl. ..... 266/273; 266/271

[58] Field of Search ..... 266/273, 271, 266/45, 272

[56] References Cited

U.S. PATENT DOCUMENTS 4,909,487 3/1990 Schneider ..... 266/273

5,395,095 3/1995 Marino et al. ..... 266/273

FOREIGN PATENT DOCUMENTS 2680179 2/1993 France ..... 266/273

*Primary Examiner*—Scott Kastler

*Attorney, Agent, or Firm*—Fishman, Dionne & Cantor

[57] ABSTRACT

Device for plugging a tap hole comprising an expulsion piston fitted in a plugging chamber, a first double-acting hydraulic actuator positioned behind the piston and a first channel passing through the piston for the passage of a piercing rod, and the first actuator. The device further comprises a second double-acting hydraulic actuator positioned behind the first actuator, equipped with a second channel for the passage of a rod, a control means for imposing a to-and-fro movement on the second actuator, and a first gripping means movable by the second actuator. This first gripping means makes it possible to grip and release a rod in order to push it, by successive travels, through the two channels in the direction of the plugging nose-piece.

13 Claims, 4 Drawing Sheets

TAP HOLE PLUGGING DEVICE

BACKGROUND OF THE INVENTION

The present invention relates to a plugging device for the tap hole of a shaft furnace, particularly a blast furnace.

It is known how to plug the tap hole of a shaft furnace by injecting tap-hole clay. A known plugging device for injecting the tap-hole clay comprises a plugging chamber receiving the tap-hole clay, a piston fitted in the plugging chamber for the expulsion of the tap-hole clay and a powerful double-acting hydraulic actuator positioned along the axis of the expulsion piston. This hydraulic actuator is a double-acting actuator which is used to move the expulsion piston axially in the plugging chamber, either to inject the tap-hole clay through a plugging nose-piece under high pressure into the tap hole, or to bring back the expulsion piston into a rear position in the plugging chamber in order to be able to fill the plugging chamber with the tap-hole clay. This plugging device is supported by a supporting structure which makes it possible to move the plugging device from a parked position, at a distance from the tap hole, into a plugging position, in which the plugging nose-piece is firmly applied against the wall of the shaft furnace along the axial alignment of the tap hole.

A process for opening the tap hole is also known in which, after having blocked the tap hole with tap-hole clay, a metallic piercing rod is driven into the clay, before it completely hardens, and in which the said rod is extracted, after the tap-hole clay has completely hardened, in order to form and open a flow channel in the tap hole. This process of opening the tap hole is generally known as "the soaking rod process" or "the embedded rod process".

For the application of this "embedded rod process", it is known how to use, alongside the plugging device described above, special drilling machines comprising a carriage to support the piercing rod, a structure for supporting the carriage designed to be able to move the carriage from a parked position at a distance from the tap hole into a operating position in which the carriage is positioned along the extension of the axis of the tap hole, a driving mechanism installed on the carriage in such a way as to develop a tractive force or pushing force parallel to the longitudinal axis of the carriage and a coupling mechanism connected to this driving mechanism so as to be able to transmit the tractive and/or pushing force axially to the piercing rod.

In order to apply the "embedded rod process", the plugging device is first brought into its plugging position and the tap-hole clay is injected into the tap hole in order to block the tap-hole. After having brought the plugging device back into its parked position, the drilling machine is aligned along the axis of the tap hole and, without wasting any time, a piercing rod is driven into the tap-hole clay which is in the process of hardening in the tap hole.

From the French patent application FR-A-2.680.179, published Feb. 12, 1993 and the entire disclosure of which is incorporated herein by reference, a device for the injection of the tap-hole clay into the tap hole of a blast furnace is known. This device makes it possible to introduce a piercing rod into the tap hole simultaneously with the tap-hole clay. For this purpose, the expulsion piston for the tap-hole clay and the hydraulic actuator driving it are equipped with an axial channel for the passage of the piercing rod. Positioned behind the actuator driving the expulsion piston, for this purpose, is a system for driving the piercing rod comprising a grooved or notched roller moved by a rotary motor, one or more guide wheels and a push rod driven by the motorized roller and guided by the guide rollers. This driving system would make it possible, according to the document FR-A-2.680.179, to push a piercing rod, previously introduced into the axial channel of the plugging device, into the tap hole simultaneously with the tap-hole clay.

It is important to note that the known plugging device of the document FR-A-2.680.179 does not enable the tap-hole clay to be injected into the tap hole first and a piercing rod then to be introduced into previously injected tap-hole clay. In fact, the tap-hole clay, in the process of hardening in the tap hole, opposes the piercing rod with such a great resistance to its advancement that the motorized push-rod/grooved-roller driving system can no longer overcome it.

SUMMARY OF THE INVENTION

The present invention provides a device for plugging the tap hole which makes it possible first to inject tap-hole clay into the tap hole and then to introduce a piercing rod into the tap-hole clay previously injected into the tap hole.

The features of the present invention are attained by a device for plugging a tap hole comprising:

a plugging nose-piece defining a plugging axis, a plugging chamber for receiving tap-hole clay, a piston fitted in the plugging chamber for the expulsion of the tap-hole clay, a first double-acting hydraulic actuator positioned along the extension of the plugging axis behind the expulsion piston, this first hydraulic actuator being connected to the expulsion piston so as to be able to move the piston in the plugging chamber between a rear position and the plugging nose-piece, and vice versa, a first channel for the passage of a piercing rod, this first channel passing through the expulsion piston and the said first hydraulic actuator and being in the extension of the said plugging axis, a second double-acting hydraulic actuator positioned along the extension of the plugging axis behind the said first hydraulic actuator, this second hydraulic actuator being equipped with a second channel for the passage of a piercing rod which passes through it along the extension of the said plugging axis, a control means for imposing on the said second actuator a back and forth movement between a rear end-of-travel position and a front end-of-travel position and vice versa, and a first gripping means for gripping and releasing as desired a piercing rod introduced into the said second channel, this first gripping means being moved along the plugging axis by the said second actuator in order to push the piercing rod, by successive travels of the said second actuator between its rear end-of-travel position and its front end-of-travel position, along the plugging axis through the said second channel and the said first channel in the direction of the plugging nose-piece.

The principal advantage of the device according to the invention is that, with a single device, it is possible:

(1) first to inject tap-hole clay into the tap hole, with a completely open cross-section, in order to block the tap hole when pouring is finished, (2) after having plugged the tap hole with the tap-hole clay, to introduce a piercing rod into the clay with an appreciable axial force.

In comparison with the process described in the document FR-A-2.680.179, the forceful introduction of the piercing rod into the tap-hole clay previously injected into the tap hole in accordance with this invention has the advantage that the tap-hole clay in the tap hole is compacted by the operation of forcefully introducing the piercing rod. This compaction has a beneficial effect on the resistance to wear of the future flow channel in the tap hole. As a result, the duration of the pourings can be increased, which, inter alia, has a beneficial effect on the operation of the shaft furnace.

A further advantage of this invention is that, in view of the fact that the same device is used to plug the tap hole and to introduce the piercing rod, and that this device may in addition, after the plugging of the tap hole, directly introduce the piercing rod into the tap-hole clay without a repositioning operation, it is possible to work with very rapidly hardening tap-hole clay. This very rapidly hardening tap-hole clay guarantees a flow channel with excellent properties, after the piercing rod has been extracted from the hardened tap-hole clay.

It will also be appreciated that the loading of the piercing rod into the device according to this invention is very simple. It is in fact sufficient to introduce the piercing rod axially into the said second channel. This operation may be performed in complete safety from behind the device. In addition, there is no need for a special push rod complicating the loading of the piercing rod. In fact, in the device according to this invention, it is possible to simply use the piercing rod provided for the next plugging operation as the push rod for a first piercing rod.

Another significant advantage obtained with the device according to this invention is that the piercing rod is fully guided from the said first gripping means until it is in the tap hole (i.e. from the point of application of the axial pushing force to the point where it is embedded in the tap hole). This eliminates the risk that the piercing rod might buckle and thus makes it possible to work with piercing rods of very small diameter. The result of this is that the flow channel obtained has a very small free cross-section, which increases the duration of a pouring and thus has a beneficial effect on the operation of the shaft furnace.

In a preferred embodiment of this invention, the plugging device is fitted with a second gripping means which can be moved along the plugging axis by the said first actuator. This second gripping means is then designed and positioned in such a way as to grip and release as desired a piercing rod introduced into the said first channel. With this device, it is possible not only to plug the tap hole and to introduce a piercing rod into the tap-hole clay previously injected into the tap hole, but also to free the embedded rod from the hardened tap-hole clay. For this purpose, the said second gripping means is used to grip the end of the piercing rod which is still protruding from the tap hole.

In an advantageous embodiment, the said first actuator and the said second actuator form a double-acting actuator comprising:

- a common cylinder positioned axially behind the plugging chamber, the said cylinder having a first axial end facing the plugging chamber and a second axial end which is opposite to the said first axial end.
- a first hydraulic piston titled in this cylinder, this first piston having a first piston rod leaving the first end of the said cylinder in a sealed manner and being connected rigidly in the plugging chamber to the expulsion piston,
- a second hydraulic piston fitted in this cylinder, this second piston comprising a second piston rod which leaves the second end of the cylinder in a sealed manner,
- the said first channel for the piercing rod passing axially through the said first piston and the first piston rod, and
- the said second channel for the piercing rod passing axially through the said second piston and the second piston rod.

This embodiment is distinguished by its simplicity and by its reduced overall length.

In order to complete the guiding channel for the piercing rod inside the said double actuator and in order to provide a simple solution to problems of sealing, a double actuator is provided in which:

- either the first piston or the second piston carries an axial sleeve which can be fitted axially and in a sealed manner into a corresponding axial cavity made in the opposite piston,
- the said axial sleeve defining, along the extension of the plugging axis, an intermediate channel connecting the said first channel to the said second channel.

The first gripping means advantageously comprises a pair of jaws positioned symmetrically around the said second channel and movable obliquely in a direction opposite to the plugging chamber towards the axis of the said second channel in such a way as to bite into a piercing rod introduced into this second channel. It will be appreciated that the greater the pushing force transmitted to the piercing rod, the more the jaws bite into the piercing rod.

The second gripping means advantageously comprises a pair of jaws positioned symmetrically around the said first channel and movable obliquely in the direction of the plugging nose-piece towards the axis of the said first channel in such a way as to bite into a piercing rod introduced into this first channel. It will be appreciated that the greater the tractive force transmitted to the piercing rod, the more the jaws bite into the piercing rod.

In order to prevent the tap-hole clay penetrating into the said first channel, the first channel is advantageously fitted with a blocking mechanism. This blocking mechanism may be equipped with a means of actuation so as to allow the closure of the said first channel during the actual plugging operation and its opening up, when the plugging operation is finished, for the introduction of the piercing rod into the tap hole. The said blocking mechanism is advantageously a pivotable flap valve, opening in the direction of the plugging chamber and closing under gravity and/or with the help of a spring. The opening of this flap valve is carried out by the piercing rod itself during its penetration into the plugging chamber. Its closure in the absence of a piercing rod is automatic. The plugging pressure contributes to the force keeping the flap valve closed. There is thus no need for additional power in order to close or open the blocking mechanism of the said first channel.

The device according to this invention is advantageously completed by a handling device designed to support a piercing rod axially along the extension of the said second channel in such a way that one end of the piercing rod thus supported may be gripped by the said first gripping means when the said second actuator is in its rear end-of-travel position. This handling device for piercing rods eliminates the need for any human intervention in the operation of loading the piercing rod in the device according to the invention.

It will be appreciated that a particularly simple embodiment of such a device for handling piercing rods is thus described.

BRIEF DESCRIPTION OF THE DRAWINGS:

Referring now to the drawings, wherein like elements are numbered alike in the several Figures.

DESCRIPTION OF THE PREFERRED EMBODIMENT

Figure 1:
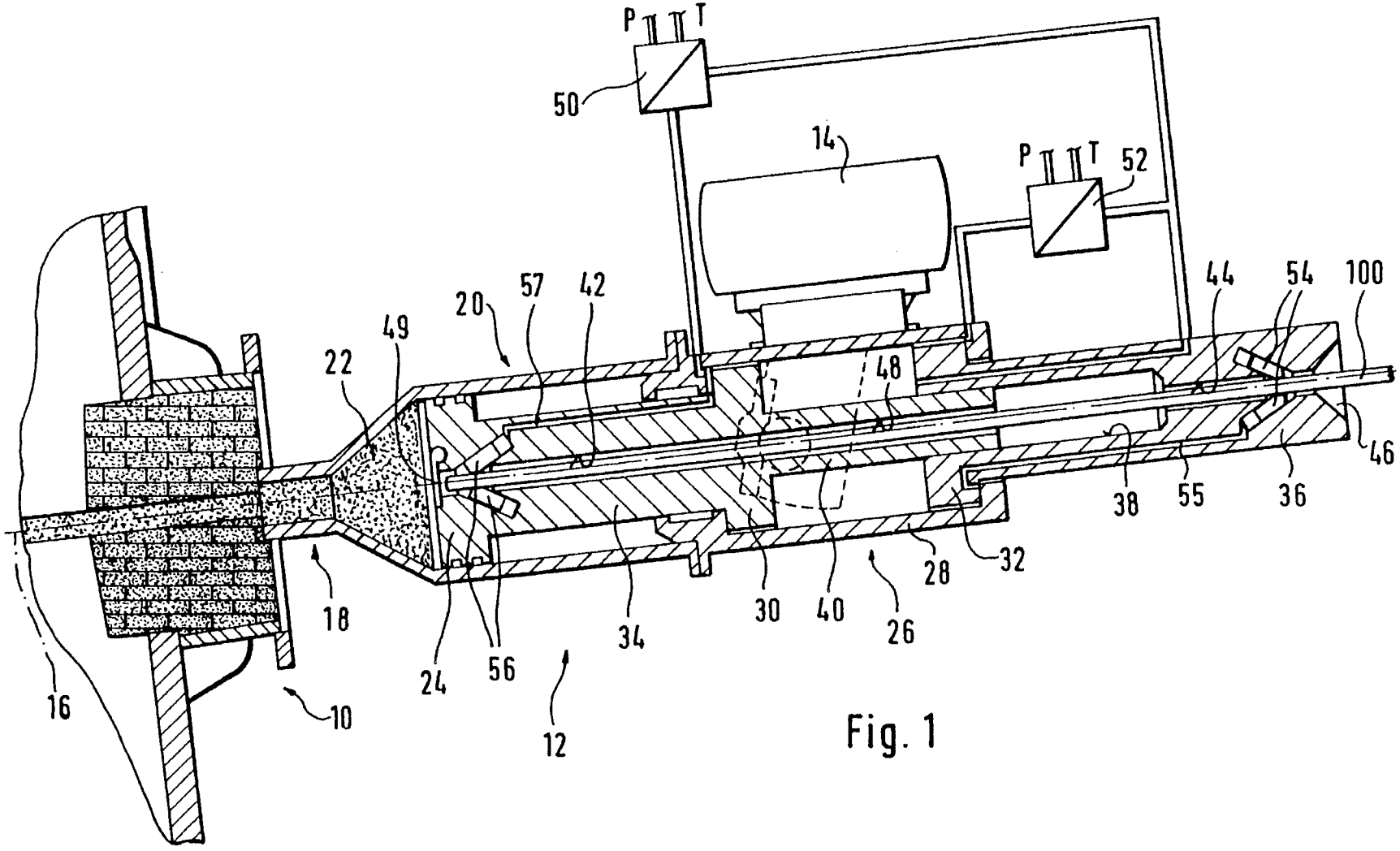
FIG. 1 is a diagrammatic cross-section through a plugging device according to the present invention.

FIG. 1 shows a cross-section through a tap hole 10 of a shaft furnace, for example a blast furnace. Opposite this tap hole is positioned a plugging device 12 according to the present invention. This plugging device 12 for the tap hole 10 is supported by a support 14 which enables the plugging device 12 to be pivoted or moved from a parked position located at a distance from the tap hole into a plugging position (as shown in FIG. 1). It will be noted that in this plugging position the plugging device 12 is aligned axially with the axis 16 of the tap hole 10 and is firmly pressed against the tap hole 10.

The plugging device 12 comprises a plugging nose-piece 18 which is fitted with an orifice for the exit of the tap-hole clay. Hereinafter, the central axis of this exit orifice is referred to as the plugging axis of the device 12. In the plugging position, this plugging axis is aligned along the axis 16 of the tap hole.

The plugging nose-piece 18 forms the front end of a plugging chamber 20, designed to receive tap-hole clay 22 which is to be injected into the channel of the tap hole 10 in order to block the tap hole. The plugging chamber 20, is preferably cylindrical in cross section, and an expulsion piston 24 is fitted in the plugging chamber. Piston 24 is capable of moving axially in the plugging chamber 20 from a rear position towards the plugging nose-piece 18 in order to inject the tap-hole clay 22 through the plugging nose-piece 18 into the tap hole 10. In order to be able to fill the plugging chamber 20 with the tap-hole clay 22, it is of course necessary to bring the expulsion piston 24 back into its rear position.

Behind the plugging chamber 20, i.e. on the side opposite the plugging nose-piece 18, there is a hydraulic double actuator 26. This hydraulic double actuator 26 includes a pressure cylinder or body 28 which is supported by the support 14. The plugging chamber 20 is fixed axially to this cylinder 28, axially one behind the other. Two independent hydraulic pistons 30 and 32 are titled axially, one behind the other, in cylinder 28. The first piston 30, i.e. that located nearest to the plugging chamber 20, has a first piston rod 34 which exits axially in a sealed manner from the cylinder 28 so as to enter the plugging chamber 20, where it is connected to the expulsion piston 24 for the tap-hole clay 22. The second piston 32, i.e. that located farthest from the plugging chamber 20, has a piston rod 36 which exits axially in a sealed manner from the cylinder 28 on the side opposite the plugging chamber 20. The second piston 32 has an axial cavity. 38 which extends axially in the second piston rod 36 in such a way as to have a depth greater than the travel of the two pistons 30 and 32 in the cylinder 28. Cavity 38 receives, in a sealed manner, a sleeve 40 attached to the first piston 30. The length of this sleeve 40 is greater than the travel of the two pistons 30 and 32 in the cylinder 28, but slightly smaller than the depth of the cavity 38. In this way, the sleeve 40 forms a "bridge" of variable length between the first piston 30 and the second piston 32. It should be pointed out that this "bridge" does not reduce the travel of the two pistons 30 and 32 in the cylinder 28, since the depth of the axial cavity 38 is greater than the length of the sleeve 40.

A first channel 42 passes axially through the expulsion piston 24, the first piston rod 34 and the first hydraulic piston 30. The second piston rod 36 has a second channel 44 which extends axially from the cavity 38 into a conical outlet 46 positioned axially in the free end of the second piston rod 36. The first and second channels 42 and 44 are connected axially by a channel 48 passing through the sleeve 40. The free cross-section of these channels 42, 44, 48 is so chosen that a piercing rod 100 can easily be made to pass through each of these channels. Preferably, the free cross-section of these channels 42, 44, 48 is, however, only slightly greater than the transverse cross-section of the piercing rod 100, in order to provide optimum guidance for the piercing rod and thus to prevent its buckling. It should also be pointed out that the axes of all these channels 42, 44, 48 are aligned with the plugging axis defined by the plugging nose-piece 18. In this way the plugging device 12 has a rectilinear channel allowing the passage of a piercing rod 100 from the rear, through the conical outlet 46, the double actuator 26, the expulsion piston 24, the plugging chamber 20 and the plugging nose-piece 18.

The outlet from the first channel 42 into the plugging chamber 20 is protected against penetration of the tap-hole clay by a blocking mechanism, for example a flap valve 49. This flap valve 49 is advantageously a pivotable flap valve which is closed either by gravity and/or by using an incorporated spring. It is opened by the piercing rod 100 when the latter is pushed through the expulsion piston 24 in the direction of the plugging nose-piece 18. As a replacement for a blocking mechanism, it would be possible to provide in the first channel 42 a sealing mechanism, similar to a stuffing box, which co-operates with the piercing rod 100 to prevent the penetration of the tap-hole clay into this channel 42. This sealing mechanism could advantageously incorporate at least one inflatable seal. The blocking mechanism has the advantages of guaranteeing more reliable sealing and of being able to work with piercing rods of different diameters. The sealing mechanism has the advantage of being able to move the piercing rod forward as far as the plugging nose-piece 18 before filling the plugging chamber 20 with clay. In this way, it is possible to begin the operation of introducing the piercing rod into the tap hole at the same time as the operation of injecting the clay into the tap hole. Of course, it is also possible to provide a blocking mechanism and a sealing mechanism in series, which makes it possible to benefit simultaneously from the advantages of both mechanisms.

The first piston 30 of the double actuator 26 serves as a driving piston for the expulsion piston 24. A first hydraulic control unit 50 makes it possible to move the first hydraulic piston 30 in the cylinder 28, either to the left or to the right, in order thus to move the expulsion piston 24 in the plugging chamber 20 from its rear position towards the plugging nose-piece 18 to inject the tap-hole clay through the plugging nose-piece 18 into the tap hole, or, alternatively, from the plugging nose-piece 18 into its rear position in order to be able to fill the plugging chamber 20 with tap-hole clay 22.

The second piston 32 is connected to a second hydraulic control unit 52 making it possible to impose on this second piston 32 a back and forth movement in the cylinder 28. It will be appreciated that the first piston 30 and the second piston 32 both have a travel maximum stroke "C" defined by the length of cylinder 28 minus the thickness of the two pistons, but that the total length of the cylinder 28 is less than the aggregate travel of the two pistons 30 and 32.

Incorporated in the second piston rod 36, preferably in the immediate neighborhood of the conical outlet 46, is a pair of jaws 54. These jaws 54 are preferably positioned symmetrically around the second channel 44 and are capable of being moved obliquely in the direction of the conical outlet 46 towards the axis of this channel 44 in such a way as to be able to bite into the piercing rod 100 when the latter is introduced into the second channel 44. These jaws 54 are preferably hydraulically or pneumatically actuated. When they are hydraulically actuated, they are advantageously connected through a channel 55 of the piston rod 36 to a first pressure chamber of the pressure body 28. More precisely, this is the pressure chamber whose pressurizing causes the advance of the second piston 32 toward the plugging nose-piece 18. In this way, the jaws 54 are automatically actuated to closure by the hydraulic fluid supplying the actuator 26 in order to move the piston 32 in the direction of the plugging nose-piece 18. Springs provide for the release of the jaws 54 in the absence of hydraulic pressure in the said first hydraulic chamber. It will also be appreciated that such a pair of jaws 54 forms an efficient and reliable method for gripping rod 100 in the channel 44 and for applying a considerable pushing force to rod 100 in the direction of the tap hole.

The operative mode of the plugging device 12 is described with reference to FIGS. 2 to 6.

Figure 2:
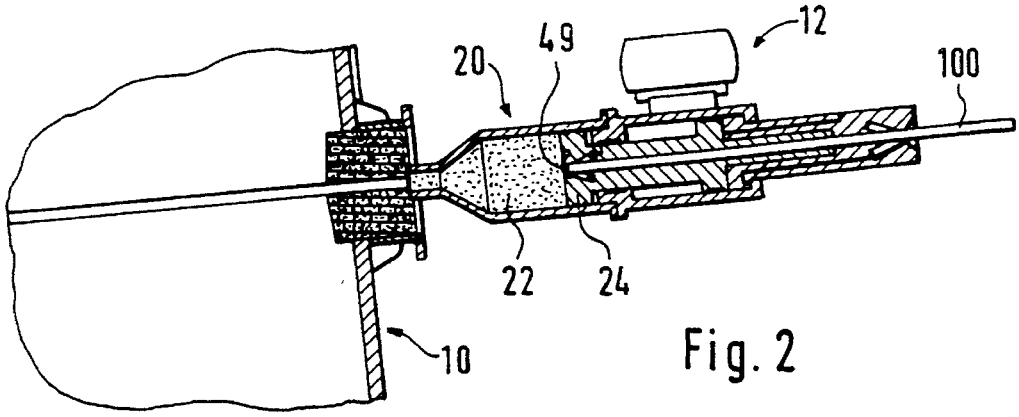
FIGS. 2,3,4,5 and 6 represent a sequence illustrating the functioning of the device of FIG. 1.

In FIG. 2, the plugging device 12 is in the plugging position in front of the tap hole 10. The plugging chamber 20 is filled with tap-hole clay 22 intended for injection by the expulsion piston 24 into the channel of the tap hole 10. A piercing rod 100 is inserted into the axial channel 44, 48, 42 of the plugging device 12 as far as the flap valve 49 which is in the closed position.

Figure 3:
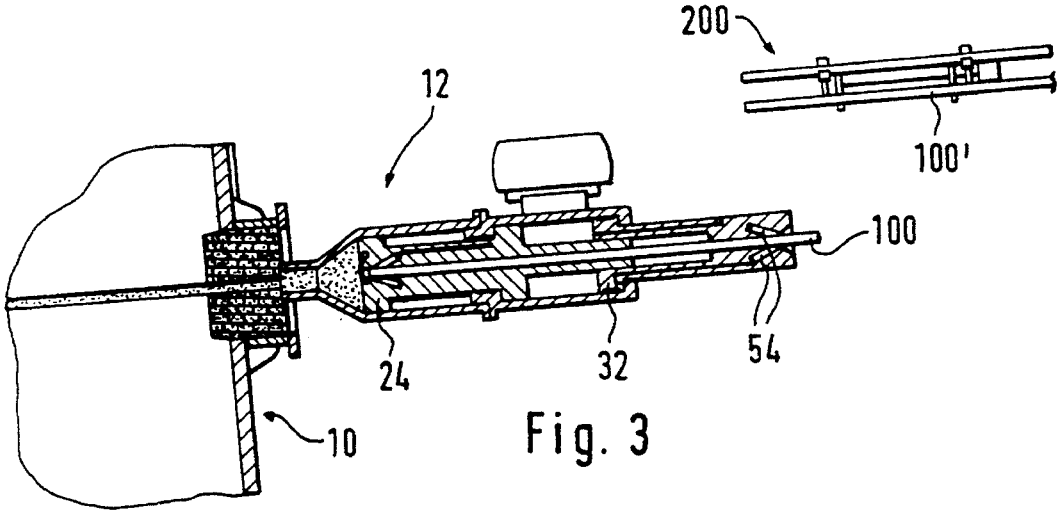

In FIG. 3, the expulsion piston 24 is shown in the front end-of-travel position, after having injected the tap-hole clay 22 into the channel of the tap hole 10. The flap valve 49 is still in the closed position. Most frequently, the piercing rod 100 will have substantially followed the movement of the expulsion piston 24, owing to the inclination of the plugging device and to the movement of the system consisting of the expulsion piston 24, the first piston rod 34, the first hydraulic piston 30 and the sleeve 40. It should in fact be pointed out that the two jaws 54 do not grip the piercing rod 100 during the actual plugging operation, but that this piercing rod 100 rests freely in the axial channel 44, 48, 42 of the plugging device 12. FIG. 3 also shows a handling device 200 on which is supported a piercing rod 100', which will be introduced into the tap hole 10 during the next plugging operation.

Figure 4:
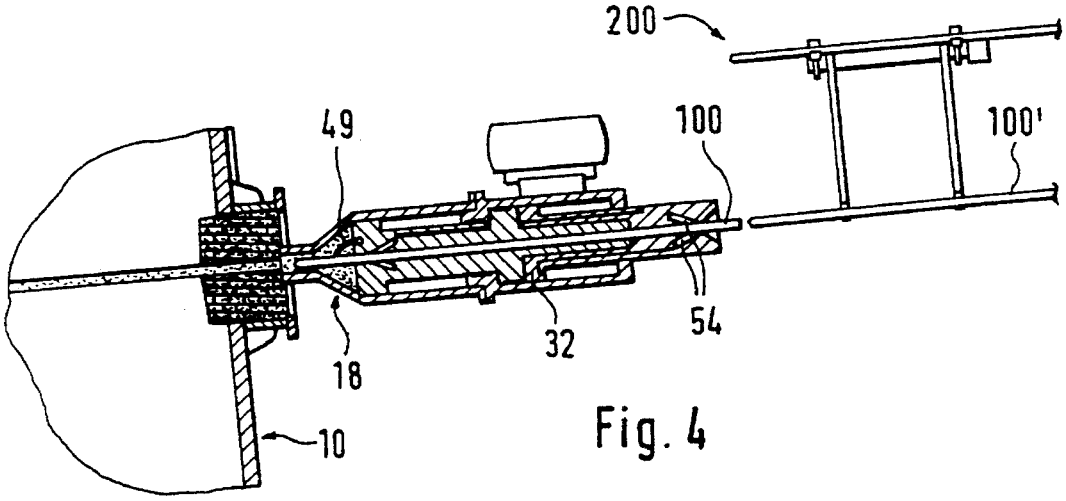

The plugging operation being finished, the jaws 54 are actuated so as to grip the piercing rod 100. The second hydraulic piston 32 is then actuated so as to drive the piercing rod 100 through a travel "C" in the direction of the tap hole 10. FIG. 4 shows that, during this movement of travel "C", the front tip of the piercing rod 100 has opened the flap valve 49 and has penetrated the residual tap-hole clay in the plugging nose-piece 18. The jaws 54 are then opened.

If the length of the piercing rod 100 extending beyond the jaws 54 in the direction opposite the tap hole 10 is greater than the travel "C" of the second hydraulic piston 32, the latter is brought back into its initial position in which the jaws 54 are closed in order once again to grip the piercing rod 100. The piercing rod 100 is then moved by a second travel "C" in the direction of the tap hole 10, now causing the front end of the piercing rod 100 to penetrate the tap-hole clay previously injected into the channel of the tap hole 10. If the length of the piercing rod 100 extending beyond the jaws 54 in the direction opposite the tap hole 10 is less than the travel "C" of the second hydraulic piston 32, as is the case in FIG. 4, the handling device 200 brings the next piercing rod 100' axially into the extension of the axis of the said second channel 42, before the second hydraulic control unit 52 brings the second hydraulic piston 32 back into its initial position.

Figure 5:
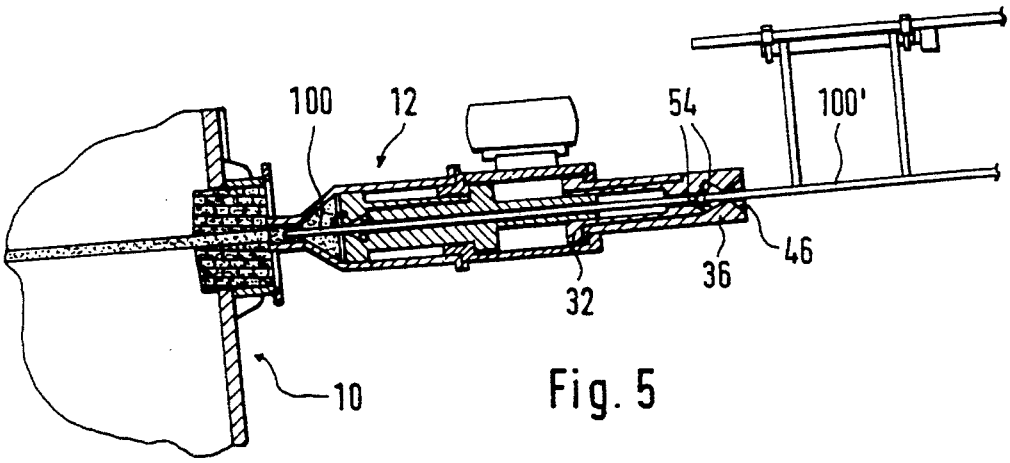

FIG. 5 shows the second hydraulic piston 32 in its initial position. During the withdrawal of the second piston rod 36, the front end of the piercing rod 100', waiting on the handling device 200, penetrates through the outlet cone 46 into the second channel 44 of the second piston rod 36. The next step now consists in gripping this piercing rod 100' using the jaws 54 and in moving it, by actuating the second hydraulic piston 32, in the direction of the tap hole 10. Inside the channel 44, 48, 42, the front end of the piercing rod 100' now presses on the rear end of the piercing rod 100 and forces the latter into the tap-hole clay previously injected into the channel of the tap hole.

Figure 6:
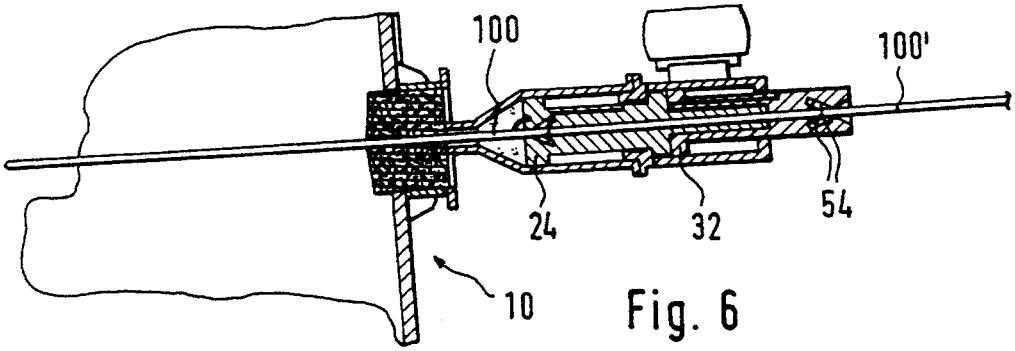

FIG. 6 shows the plugging device 12 after the operation of introducing the piercing rod 100 into the channel of the tap hole 10. It will be noted that the rear end of the piercing rod 100 is now located in the first channel 42 at the position of the expulsion piston 24. In order to reach this position, it has of course been necessary to impose on the piercing rod 100', using the second hydraulic piston 32, several movements of travel "C" in the direction of the tap hole.

Figure 7:
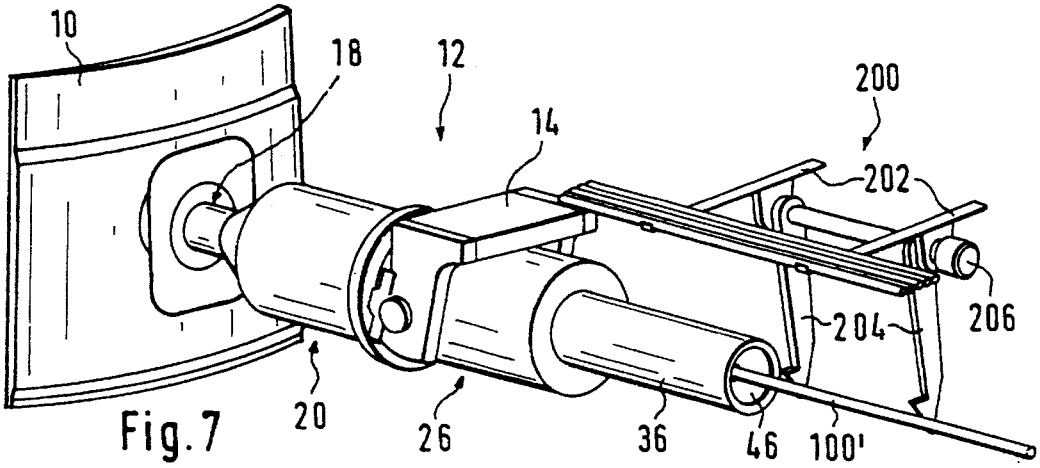
FIG. 7 is a perspective view of the device of FIG. 1 fitted with a handling device for the piercing rods.
Figure 8:
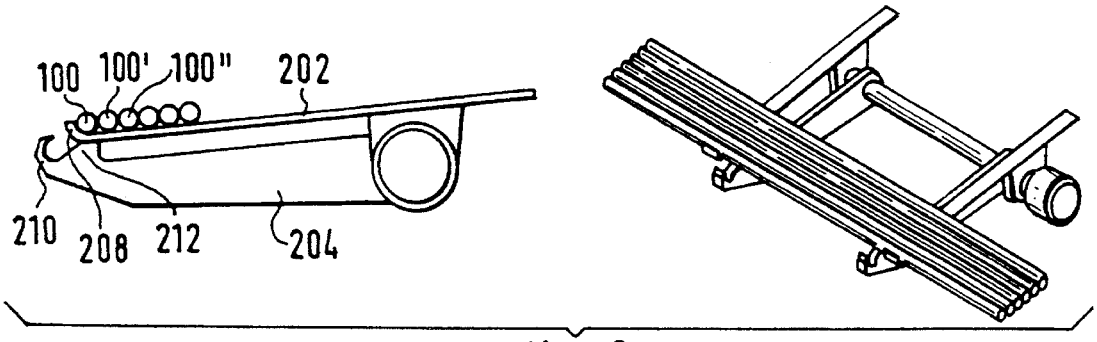
FIGS. 8,9,10 and 11 illustrate the functioning of the handling device of FIG. 7.
Figure 9:
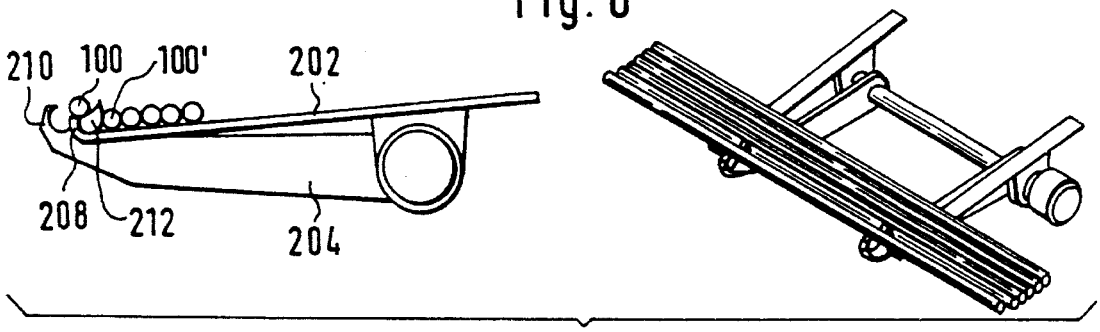

FIG. 7 shows a perspective view of the plugging device 12 with its device 200 for handling the piercing rods in the state of FIG. 5. The handling device 200 comprises one pair of fixed arms 202, one pair of pivotable arms 204, and a driving mechanism 206 for the pivotable arms 204. The operation of handling device 200 is described with reference to FIGS. 8 to 11.

The fixed arms 202 are used to support a reserve supply of several piercing rods 100, 100', 100". Arms 202 define an inclined plane on which the piercing rods are placed parallel one against the other, their axes being perpendicular to the slope of the inclined plane. It will be noted that the lowest of these piercing rods is held by flanges 208 of the fixed arms 202. Each of the pivotable arms 204 has at its free end a kind of seating or hook 210 to receive a single piercing rod. One of these seatings 210 is preferably equipped with a gripping mechanism, a clamp for example, enabling the piercing rod to be immobilized axially until it is engaged in the channel 44 of the second actuator rod 36. In front of each of these seatings 210 is also positioned a protruding element 212. These protruding elements 212 are designed and positioned in such a way as to penetrate, by a pivoting of the pivotable arms 204, between the piercing rod 100, held by the flanges 208, and the piercing rod 100', directly in contact with the piercing rod 100, to lift the piercing rod 100 over the flange 208 and to drop it into the hooks 210 (cf. FIGS. 8, 9 and 10).

Figure 10:
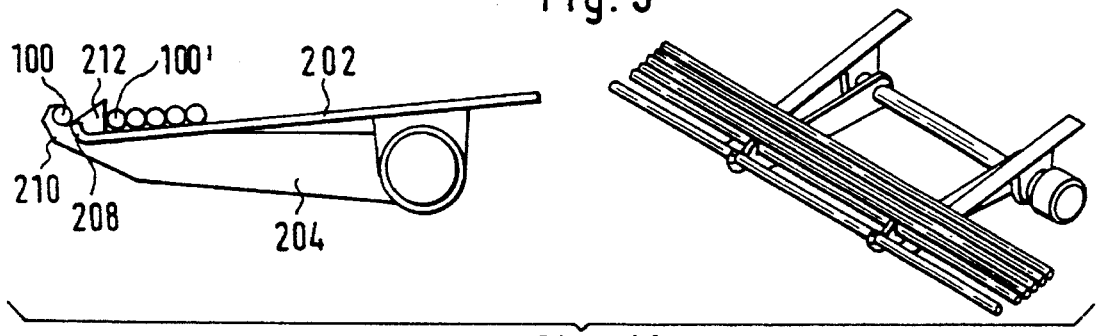
Figure 11:
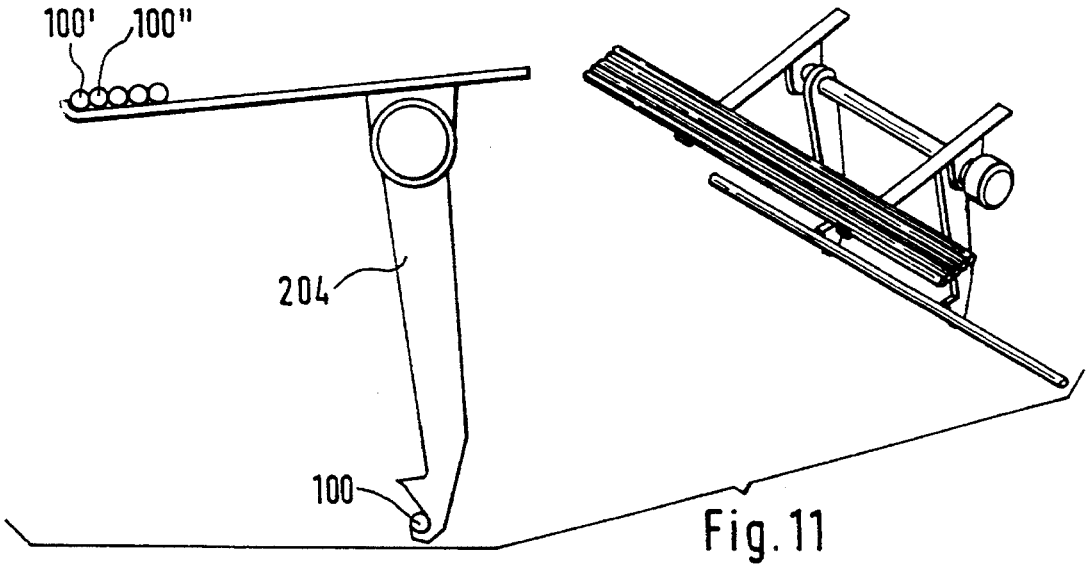

In FIG. 10, the piercing rod 100 is supported by the hooks 210 of the pivotable arms 204 and preferably immobilised by the above-mentioned gripping mechanism. The pivotable arms are then swivelled into the position of FIG. 11, in which the piercing rod 100 is supported in the axial extension of the second channel 44 of the plugging device 12. In this position, the piercing rod 100 can be gripped by the jaws 54 incorporated in the piston rod 36 when the latter has completely exited from the cylinder 28.

The above account has described the injection of the tap-hole clay into the tap hole 10 and the introduction of a piercing rod 100 into the previously injected tap-hole clay. In order to open the tap hole and to form its flow channel, it is of course necessary to be able to withdraw the piercing rod 100 from the hardened tap-hole clay in the tap hole 10. This operation may advantageously be performed by the device described above, in which a second gripping means has been incorporated in the first piston rod 34, preferably in the immediate neighborhood of the outlet from the first channel 42 in the plugging chamber 20. This may be, for example, a pair of jaws 56 identical to the jaws 54 but oriented in the opposite direction: i.e. the jaws 56 move obliquely in the direction of the plugging nose-piece 18 towards the axis of the first channel 42 so as to bite into the piercing rod 100 penetrating the channel 42. This pair of jaws 56 makes it possible to transmit to a rod inserted in the first channel 42 a considerable tractive force in the direction opposite to the tap hole 10. Jaws 56 are advantageously actuated hydraulically through a channel 57 which connects jaws 56, through the first piston rod 34, to a second pressure chamber of the actuator 26. More precisely, this is a pressure chamber whose pressurizing causes the first hydraulic piston 30 to be withdrawn. In this way, the jaws 56 are automatically actuated to closure so as to grip the piercing rod when the first piston 30 is displaced to the rear. Springs provide for the release of the jaws 56 when the said second pressure chamber is no longer pressurized.

Because of the second pair of jaws 56, it is possible to couple the first piston 30 to the end of the piercing rod 100 which protrudes from the tap hole. By imposing on the first piston 30 a withdrawing movement of travel "C" in the direction opposite to the tap hole, the piercing rod 100 is thus freed over a first length "C". The jaws 56 are then opened and the hydraulic piston 30 is brought forward so as to grip the piercing rod 100 a second time with the jaws 56 and so as to extract it over a second length "C", and so on. It is also possible however to grip the rear end of the piercing rod using the jaws 56 and to withdraw the entire plugging device 12 using the support 14 in order, in this way, to withdraw the piercing rod 100 from the tap-hole clay injected in the tap hole. Of course, it would also be possible to bring the plugging device back to its parked position immediately after having introduced the piercing rod 100 into the tap hole 10. The piercing rod would then be extracted by another While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for plugging a tap hole comprising:

an elongated housing;

a plugging nose-piece at one end of said housing, said plugging nose-piece having a discharge orifice, and said plugging nose-piece having a plugging axis;

a first chamber in said housing for receiving tap-hole clay;

an expulsion piston in said plugging chamber for the expulsion of the tap-hole clay;

first actuator means positioned in said housing along said plugging axis, said first actuator means being connected to said expulsion piston so as to be able to move said expulsion piston in the first chamber between a rear position and the plugging nose-piece, and vice versa;

first control means for causing movement of said first actuator means and said expulsion piston;

a first channel for the passage of a piercing rod, said first channel passing through said expulsion piston and said first actuator means, said first channel being along said plugging axis;

second actuator means positioned in said housing along said plugging axis, said second actuator means having a second channel for the passage of a piercing rod, said second channel being along said plugging axis;

second control means for causing said second actuator means to move between a rear end-of-travel position and a front end-of-travel position and vice versa; and first gripping means for gripping and releasing a piercing rod introduced into said second channel, said first gripping means being carried by said second actuator means and being moved along said plugging axis by said second actuator means to push the piercing rod, by successive travels of the said second actuator means between its rear end-of-travel position and its front end-of-travel position, along the plugging axis through the said second channel and the said first channel in the direction of the plugging nose-piece.

2. Apparatus for plugging a tap hole as in claim 1, further comprising:

second gripping means carried by said first actuator means, said second gripping means being moved along said plugging axis by said first actuator means, said second gripping means being positioned to successive grip and release a piercing rod introduced into said first channel.

3. Apparatus for plugging a tap hole as in claim 1, including:

an actuation cylinder positioned axially adjacent said plugging chamber, the said actuation cylinder having a first axial end facing said plugging chamber and a second axial end spaced from said first axial end;

said first actuator means including a first hydraulic piston in said actuation cylinder, and a first piston rod extending from said first end of said actuation cylinder and being connected to said expulsion piston;

said second actuator means including a second hydraulic piston in said actuation cylinder, and a second piston rod extending from said second end of said actuation cylinder;

said first channel for the piercing rod passing axially through said first piston and said first piston rod; and said second channel for said piercing rod passing axially through said second piston and said second piston rod.

4. Apparatus for plugging a tap hole as in claim 3, including:

an axial cavity in one of said first and second pistons, said axial cavity being along said plugging axis;

an axial sleeve extending from the other of said first and second pistons, said axial sleeve extending into said axial cavity in said one piston;

said axial sleeve including an intermediate channel along said plugging axis, said intermediate channel connecting said first channel to said second channel.

5. Apparatus for plugging a tap hole as in claim 1, wherein:

said first gripping means comprises a first pair of jaws positioned symmetrically around the said second channel, said jaws being movable obliquely in a direction opposite to the plugging chamber toward the axis of said second channel to bite into a piercing rod in said second channel.

6. Apparatus for plugging a tap hole according to claim 5, wherein:

said first pair of jaws are actuated hydraulically through a hydraulic channel of said second actuator means to cause their closure when said second control means imposes on said second actuator a movement toward said front end-of-travel position.

7. Apparatus for plugging a tap hole according to claim 2, wherein:

said second gripping means comprises a second pair of jaws positioned symmetrically around said first channel, said jaws being movable obliquely in the direction of the plugging nose-piece towards the axis of said first channel to bite into a piercing rod in said first channel.

8. Apparatus for plugging a tap hole according to claim 7, wherein:

said second pair of jaws are actuated hydraulically through a hydraulic channel of said first actuator means to cause their closure when a movement toward said rear position is imposed on said first actuator means.

9. Apparatus for plugging a tap hole as in claim 1 including:

blocking means for closing said first channel to prevent the tap-hole clay entering said first channel.

10. Apparatus for plugging a tap hole as in claim 9, wherein:

said blocking means is a pivotable flap valve attached to said expulsion piston and opening in the direction of said plugging chamber.

11. Apparatus for plugging a tap hole according to any of claims 1 to 10, including:

handling means to support a piercing rod axially along the extension of said second channel whereby one end of said piercing rod may be gripped by said first gripping means when said second actuator is in its rear end-of-travel position.

12. Apparatus for plugging a tap hole according to claim 11, wherein the said handling device for the piercing rods comprise:

fixed supporting arms for supporting an array of several piercing rods, said fixed arms defining an inclined plane on which the piercing rods are held parallel one against the other with their axes being perpendicular to the slope of the inclined plane;

said fixed supporting arms having end flanges, and the lowest piercing rod being held by said end flanges of the fixed arms;

pivotable handling arms including a seating section for receiving a single piercing rod;

said pivotable handling arms each including a protruding element lift, the piercing rod held by said flanges over said flanges and to drop it into said seating section; and driving means for pivoting said pivotable arms between a lower position in which a piercing rod supported in said seating section is positioned along said plugging axis and an upper position in which said protruding element lifts a new piercing rod over said flanges.

13. Apparatus for plugging a tap hole according to claim 12, wherein the pivotable handling arms are equipped with gripping means to immobilize the piercing rod axially in said seating section.

* * * * *